US005106218A

United States Patent [19]

Gomoll et al.

[11] Patent Number: 5,106,218

[45] Date of Patent: Apr. 21, 1992

[54] PRINTER WITH A SUBSTRATE SUPPORT, IN PARTICULAR MATRIX PIN PRINTER

[75] Inventors: Günter Gomoll, Nersingen/Leibi; Wolfgang Hauslaib, Langenau; Ulrich Buschmann, Elchingen, all of Fed. Rep. of Germany

[73] Assignee: Mannesmann Aktiengesellschaft, Düsseldorf, Fed. Rep. of Germany

[21] Appl. No.: 624,713

[22] Filed: Dec. 6, 1990

[30] Foreign Application Priority Data

Dec. 6, 1989 [DE] Fed. Rep. of Germany ..... 3940776

[51] Int. Cl.[5] ..... B41J 11/053

[52] U.S. Cl. ..... 400/661; 400/660; 400/661.1

[58] Field of Search ..... 400/457, 656, 657, 658, 400/660, 661, 661.1, 689; 181/201, 207, 208

[56] References Cited

U.S. PATENT DOCUMENTS 4,318,452 3/1982 Reitner ..... 400/661

FOREIGN PATENT DOCUMENTS 221837 5/1987 European Pat. Off. ..... 400/661.1
2844514 4/1979 Fed. Rep. of Germany ..... 400/656
192670 10/1985 Japan ..... 400/661
248762 11/1986 Japan ..... 400/689
2062126 5/1981 United Kingdom ..... 400/660

OTHER PUBLICATIONS

IBM Technical Disclosure Bulletin, Jun. 1986, "Platen Tilt Adjustment Mechanism", vol. 29, No. 1.

*Primary Examiner*—Edgar S. Burr
*Assistant Examiner*—Stephen R. Funk
*Attorney, Agent, or Firm*—Horst M. Kasper

[57] ABSTRACT

The printer with a substrate support (1) is furnished with a layer structure in a print support cross-section (11). The layer structure comprises a metallic print bar (13), a vibration-attenuating damping layer (14), and a metallic intermediate layer (15) disposed sequentially in print element operation direction (12), where the intermediate layer (15) acts only functionally as "intermediate layer." In order to avoid a space-requiring and bulky layer structure of an insulating layer (16), neutralizing the frequencies of contacting components, the frequency-neutralizing insulating layer (16) is formed by elastic caps (18) at the ends (17*a*, 17*b*) of a unit, where the unit is formed by print bar (13), damping and absorbing layer (14), and intermediate layer (15). The elastic caps (18) can be slid into the recesses (19) of the printer side walls (20).

14 Claims, 3 Drawing Sheets

PRINTER WITH A SUBSTRATE SUPPORT, IN PARTICULAR MATRIX PIN PRINTER

BACKGROUND OF THE INVENTION

1. Field of the Invention

The invention relates to a printer with a substrate support, in particular a matrix pin printer, where the substrate support comprises layer structure in the cross-section running perpendicular to the substrate support, where the layer structure comprises a metallic print bar, a vibration-reducing damping layer, and a metallic intermediate layer, sequentially following in print element operating direction, as well as a frequency-neutralizing insulating layer.

2. Brief Description of the Background of the Invention Including Prior Art

Such substrate supports are employed in so-called workplace printers and office printers, which have to operate very quietly in order not to disturb the personnel. Body-sound vibrations are generated by the print elements impacting onto the substrate support. These body-sound vibrations are conducted through the substrate support into the printer frame and thus also into the casing. These vibrations are then radiated from the printer frame and the casing as air-transmitted sound.

The German Patent document DE-3,538,762 teaches a solution to this problem which refers to the kind of operation recited above. The conventional solution of the German Patent document DE-3,538,762 consequently includes a vibration damper, comprised of a print bar, a damping layer furnished by an adhesive plastic layer, a metallic intermediate layer, where an insulating layer, made of plastics of the polymer group, follows for neutralizing the frequencies, as well as, finally, a print bar support made of metal. All these elements are disposed and supported in a special print-bar girder, wherein, however, only the print-bar support is in contact with the print-bar girder. This structure has proven advantageous from a vibration-technical point of view and the noise formation resulted in an operating noise level in the area of about 50 dB (A).

However, the structures corresponding to the teaching of the German Patent document DE-3,538,762 result in a higher cost and assembly expenditure and are obviously also associated with certain space requirements. This space would then not be available for other device groups and their construction dimensions.

SUMMARY OF THE INVENTION

1. Purposes of the Invention

It is an object of the present invention to provide a vibration-damping device group, which neutralizes the sound frequencies with at least the efficiency of an operating noise level of about 50 dB (A) which can be more economically produced.

It is another object of the present invention to furnish means for a simplified noise and vibration damping in matrix pin printers.

It is yet a further object of the present invention to provide a stable structure for the print bar of a matrix pin printer, which acts at the same time as a damping agent for the noise generated during printing operations.

These and other objects and advantages of the present invention will become evident from the description which follows.

2. Brief Description of the Invention

The present invention provides for a printer, in particular a matrix pin printer, comprising printer side walls for supporting the printer elements. A substrate support includes a layer structure sequenced along a cross-section running perpendicular to the longitudinal extension of the substrate support. The layer structure comprises a print bar, a vibration-attenuating damping layer, and a metallic intermediate layer. Said print bar, damping layer, and intermediate layer form a support unit having two ends and are arranged sequentially in print element operating direction. A frequency-neutralizing insulating layer is formed by elastic caps disposed at the ends of the support unit. The elastic caps are slid into recesses of the printer side walls.

The caps can be made of an elastic material, for example, rubber. The caps can be furnished in their corner regions with protrusions which are enlarged versus the wall sections. The protrusions of the caps can have a trapezoidal cross-section. The protrusions can be represented by the feet of arches formed into the caps. A second row of arches can be placed between the protrusions and a face of the caps contacting the support unit. The caps, mounted on the support unit including print bar, the damping layer, and the intermediate layer, can be lockingly engageable and disengageable in the recesses of the printer side walls.

According to the invention, the frequency-neutralizing insulating layer is formed by elastic caps disposed at the ends of a support unit. This support unit includes a print bar, a damping layer, and an intermediate layer. The elastic caps can be slid into recesses of the print side walls. Alternatively, the caps can be attached via protrusions mounted to the printer side walls. The caps effectively neutralize the body sound vibrations of the print bar transmitted to the printer side walls. The caps are made of a elastic synthetic material which can be fiber-reinforced such that the least possible body sound vibrations can be radiated to the device components disposed behind the caps, i.e. the resonance frequency of this spring mass vibrator is in this case substantially below the print frequency of the print elements. Thus, the invention results in a substantial simplification versus the teaching of the German Patent document DE-3,538,762. In addition, the invention structure can be more economically produced and is more advantageous relative to the space required in the construction of a printer. Additionally, the invention structure allows save and to reduce the weight of the printer.

According to a preferred embodiment, the caps, formed of an elastic material, are furnished in the corner regions with protrusion sections which are enlarged versus the wall sections. This feature results in a stiffer construction, relative to a simple structure based on the same weight of material, i.e. in a more rigid support of the recited unit in the side walls, without negatively influencing the frequency insulation and a neutralizing of the sound noise.

For purposes of simplicity, it is further provided that the caps are formed of rubber material.

According to further features of the invention, the caps, mounted on the print bar, on the damping and absorbing layer, and on the intermediate layer, can be lockingly engaged in and disengaged from the recesses of the printer side walls, or the engagement means of the printer side walls. Based on this feature, the assembly of the substrate support is made substantially easier and it is possible to exchange the substrate support as a whole against a new substrate support or against a modified substrate support without demounting for servicing or for performing any desired service work in the interior work of the printer.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
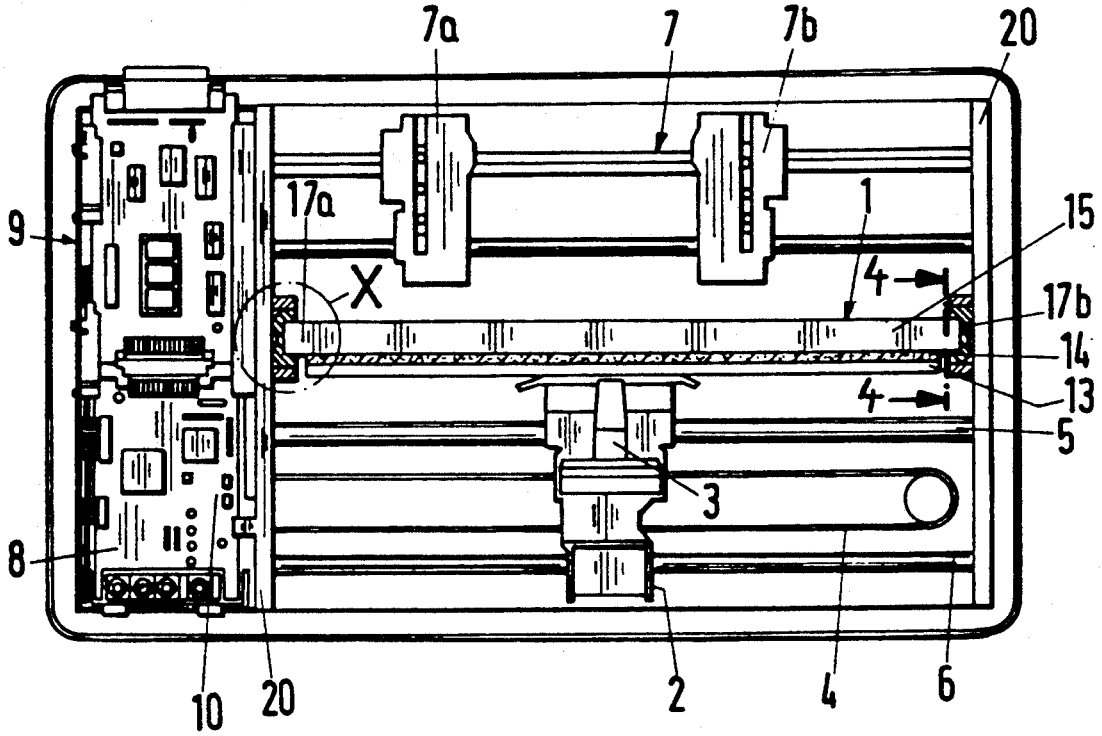
FIG. 1 is a top plan view onto an open matrix pin printer with a substrate support.

The matrix printer is illustrated in FIG. 1 without the upper casing half in order to allow a view into the interior of the matrix printer. The matrix pin printer includes a substrate support. The substrate support comprises a layer structure sequenced along a cross-section running perpendicular to the longitudinal extension of the substrate support. The layer structure comprises a print bar, a vibration-attenuating damping layer, and a metallic intermediate layer, arranged sequentially in print element operating direction, as well as a frequency-neutralizing insulating layer. The frequency-neutralizing insulating layer 16 is formed by elastic caps 18 disposed at the ends 17*a*, 17*b* of a unit 17. The unit 17 comprises the print bar 13, the damping and absorbing layer 14, and the intermediate layer 15. The elastic caps 18 can be slid into recesses 19 of the printer side walls 20.

The caps 18, made of an elastic material, can be furnished in the corner regions 18*a* with protrusions 18*b* which are enlarged versus the wall sections 18*c*. The caps 18 can be made of rubber. The caps, mounted on the print bar 13, the damping layer 14, and the intermediate layer 15, can be lockingly engageable and disengageable in the recesses 19 of the printer side walls 20.

The essential device groups include a substrate support 1 with a slider 2, movable back and forth in parallel to the substrate support 1, and supporting a matrix print head 3, and actuated by a belt drive 4. The slider 2 is supported or guided, respectively, on a guide axle 5 and on an axle 6. A push tractor device 7 with push tractors 7*a* and 7*b* is disposed in the rear part of the matrix printer. A separate compartment 8 for an electronics 9 and for a slider drive motor 10 and the like is furnished in the left part of the matrix printer.

Figure 2:
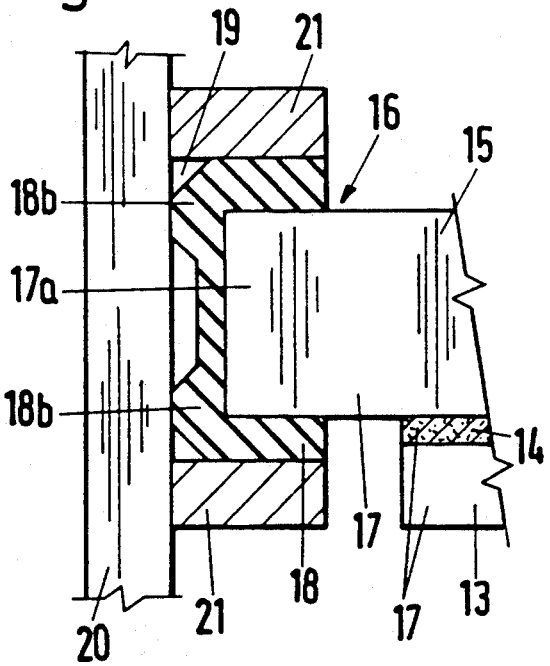
FIG. 2 is a top plan view onto the substrate support at an enlarged scale in the region of the detail "X" of FIG. 1.
Figure 3:
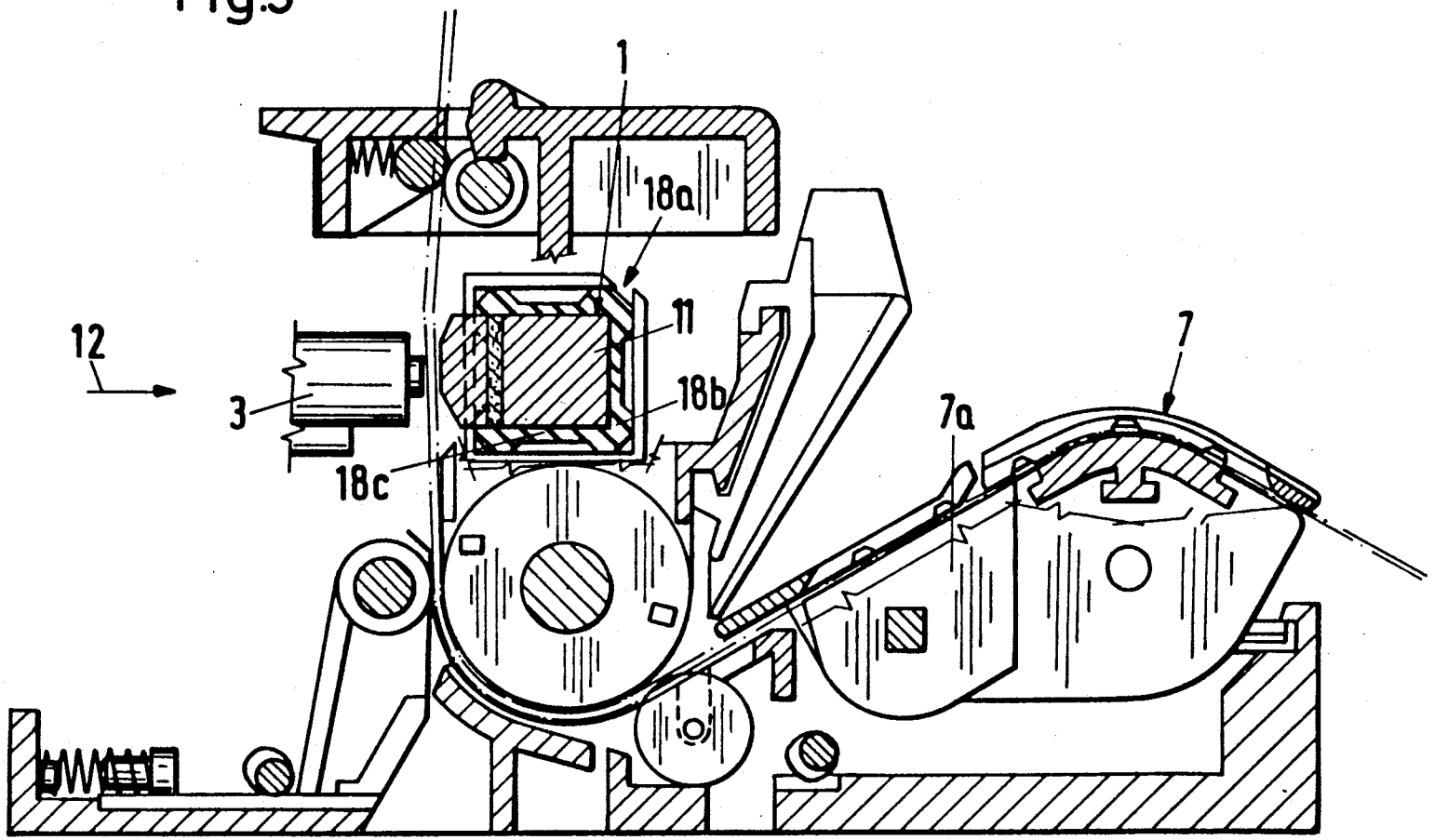
FIG. 3 is an enlarged sectional view through a matrix pin printer.

The substrate support 1, illustrated in FIG. 2, comprises a layer structure in cross-section 11 (cf. FIG. 3) running perpendicular to the longitudinal extension of the substrate support. The layer structure comprises a metallic print bar 13, a vibration-attenuating and absorbing damping layer 14, and a metallic intermediate layer 15, sequentially following in print element operating direction 12. The functionally operating intermediate layer 15 neighbors a frequency-neutralizing insulating layer 16. The frequency-neutralizing insulating layer 16 is formed as follows.

The frequency-neutralizing insulating layer 16 in each case is disposed at the ends 17*a* and 17*b* of a support unit 17. The support unit comprises the print bar 13, the damping layer 14, and the metallic intermediate layer 15. The frequency-neutralizing insulating layer 16 is formed by elastic caps 18. These caps 18 can be slid into the recesses 19 of the printer side walls 20. The caps 18 are made of an elastic material and are furnished in corner regions 18*a* with protrusions 18*b* which are enlarged as compared to the wall sections 18*c*. The caps 18 are made of rubber or of a similar elastic synthetic and/or plastic material.

Figure 4:
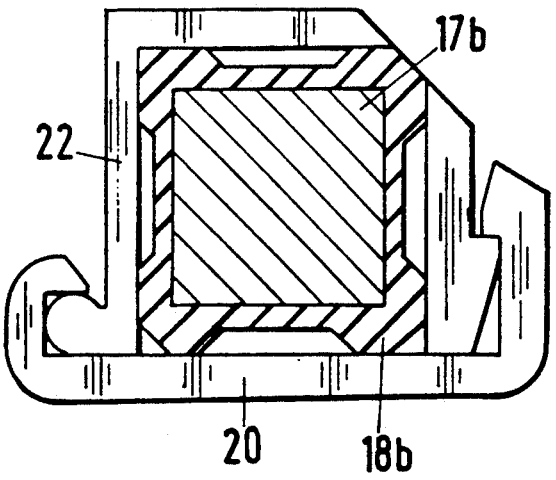
FIG. 4 is cross-section of the right substrate support attachment according to a section 4—4 of FIG. 1.

The caps 18, holding and surrounding the print bar 13, the absorbing damping layer 14, and the intermediate layer 15, are retained, based on their precise dimensions, by recess frames 21 attached to the printer side walls 20. The mounting of the support unit 17 is performed in axial direction, as seen in FIG. 1, by initially inserting the left end 17*a* and then, from the front, the right end 17*b* of the support unit 17 into the recess protrusion. In this way, the cap 18 can be locked and unlocked again, as seen in FIG. 4. The locking mechanism comprises an arm 22, where the arm 22 is furnished with protrusions, as illustrated in FIG. 4, which protrusions engage on the left and on the right under corresponding counter protrusions in the printer side wall 20.

Figure 5:
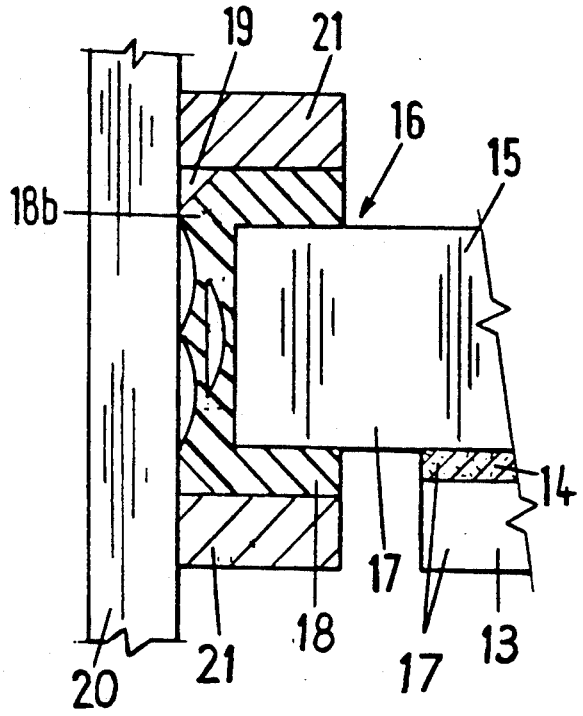
FIG. 5 is a plan view similar to that of FIG. 1 including a modified cap.

According to a further embodiment illustrated in FIG. 5, the caps 18 can be formed on their outside with arched sections. The arched sections have the purpose to provide a stable structure while at the same time minimizing the sound transmission from the cap to the side walls. A further damping of vibration transfer from the print bar to the side wall multiple arched sections can be achieved by a structure including arched sections such as having a section of two arched sections, where a first arched section is disposed on top of the second arched section and where the legs of the arches are always directed away from the location of the print bar.

The elastic material of the cap 18 is preferably such that it is suitable for damping and absorbing vibrations corresponding to the operating speed of the printer. However, the material has to be associated with a sufficient rigidity to maintain the print bar in a relatively firm position in order to allow to maintain the position of the substrate versus the incoming print pin.

It will be understood that each of the elements described above, or two or more together, may also find a useful application in other types of printers differing from the types described above.

While the invention has been illustrated and described as embodied in the context of a printer with a substrate support, in particular a matrix pin printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A printer comprising printer side walls for supporting printer elements;

a substrate support including a layer structure arranged sequentially in a direction perpendicular to a longitudinal extension of the substrate support, where the layer structure comprises a print bar, a vibration-attenuating damping layer, and a metallic intermediate layer, said print bar, damping layer and intermediate layer forming a support unit having two ends and arranged sequentially in print element operating direction;

a frequency-neutralizing insulating layer, wherein the frequency-neutralizing insulating layer is formed by elastic caps disposed at and covering the ends of the support unit, and wherein the elastic caps are slid into recesses of the printer side walls.

2. The printer according to claim 1, wherein the printer is a matrix pin printer.

3. The printer according to claim 1, wherein the caps mounted on the support unit including print bar, the damping layer, and the intermediate layer, are lockingly engageable and disengageable in the recesses of the printer side walls.

4. The printer according to claim 1, further comprising recess frames attached to the printer side walls for retaining the caps holding the support unit, the vibration-attenuating damping layer and the intermediate layer.

5. The printer according to claim 1, further comprising an arm having two sides furnished with protrusions engaging corresponding counter protrusions on the printer side walls.

6. A printer comprising printer side walls for supporting printer elements;

a substrate support including a layer structure arranged sequentially in a direction perpendicular to a longitudinal extension of the substrate support, where the layer structure comprises a print bar, a vibration-attenuating damping layer, and a metallic intermediate layer, said print bar, damping layer and intermediate layer forming a support unit having two ends and arranged sequentially in print element operating direction;

a frequency-neutralizing insulating layer, wherein the frequency-neutralizing insulating layer is formed by elastic caps disposed at and covering the ends of the support unit, and wherein the elastic caps are slid into recesses of the printer side walls; and wherein the caps are furnished with enlarged protrusions abutting the printer side walls in corner regions of the caps.

7. The printer according to claim 6, wherein the caps are made of rubber.

8. The printer according to claim 6, wherein the protrusions of the caps have a trapezoidal cross-section.

9. The printer according to claim 6, wherein the protrusions are represented by feet of a first row of arches formed into the caps.

10. The printer according to claim 9, wherein a second row of arches, wherein the second row of arches is furnished as cut outs and is placed in a middle portion of the caps between the protrusions and a face of the caps contacting the support unit.

11. A matrix pin printer with a substrate support, where the substrate support comprises a layer structure arranged sequentially in a direction perpendicular to a longitudinal extension of the substrate support, where the layer structure comprises a print bar, a vibration-attenuating damping layer, and a metallic intermediate layer, arranged sequentially in print element operating direction, as well as a frequency-neutralizing insulating layer, wherein the frequency-neutralizing insulating layer (16) is formed by elastic caps (18) disposed at and covering ends (17*a*, 17*b*) of a unit (17), where the unit (17) comprises the print bar (13), said vibration-attenuating damping layer (14), and the metallic intermediate layer (15), and wherein the elastic caps (18) can be slid into recesses (19) of printer side walls (20).

12. The printer according to claim 11, wherein the caps mounted on the print bar (13), the damping layer (14), and the intermediate layer (15) are lockingly engageable and disengageable in the recesses (19) of the printer side walls (20).

13. A matrix pin printer comprising printer side walls for supporting printer elements; a substrate support, where the substrate support comprises a layer structure arranged sequentially in a direction perpendicular to a longitudinal extension of the substrate support, where the layer structure comprises a print bar, a vibration-attenuating damping layer, and a metallic intermediate layer, arranged sequentially in print element operating direction, as well as a frequency-neutralizing insulating layer, wherein the frequency-neutralizing insulating layer (16) is formed by elastic caps (18) disposed at and covering ends (17*a*, 17*b*) of a unit (17), where the unit (17) comprises the print bar (13), said vibration-attenuating damping layer (14), and the intermediate layer (15), and wherein the elastic caps (18) can be slid into recesses (19) of the printer side walls (20), wherein the caps (18) have end portions which are furnished with enlarged protrusions (18*b*) in corner regions (18*a*) of the end portions, said enlarged protrusions (18*b*) contacting abutting the printer side walls.

14. The printer according to claim 13, wherein the caps (18) are made of rubber.

* * * * *